US008876506B2

(12) United States Patent
Steffens

(10) Patent No.: US 8,876,506 B2
(45) Date of Patent: Nov. 4, 2014

(54) DISPLACEMENT PUMP WITH INTERNAL COMPRESSION

(76) Inventor: Ralf Steffens, Lörach (DE)

( * ) Notice: Subject to any disclaimer, the term of this patent is extended or adjusted under 35 U.S.C. 154(b) by 429 days.

(21) Appl. No.: 13/408,191

(22) Filed: Feb. 29, 2012

(65) Prior Publication Data

US 2012/0171068 A1 Jul. 5, 2012

Related U.S. Application Data

(63) Continuation of application No. PCT/EP2010/061363, filed on Aug. 4, 2010.

(51) Int. Cl.
*F04C 18/16* (2006.01)
*F04C 29/04* (2006.01)
*F04C 18/08* (2006.01)

(52) U.S. Cl.
CPC ..... *F04C 18/16* (2013.01); *F04C 18/084* (2013.01); *F04C 2220/12* (2013.01); *F04C 29/04* (2013.01)
USPC ..... 418/201.1; 418/201.3; 418/194; 418/9

(58) Field of Classification Search
CPC ..... F04C 18/084; F04C 18/16; F04C 29/04
USPC ..... 418/9, 201.1, 201.3
See application file for complete search history.

(56) References Cited

U.S. PATENT DOCUMENTS 6,129,534 A * 10/2000 Schofield et al. ..... 418/9
6,497,563 B1 * 12/2002 Steffens ..... 418/201.1
7,074,026 B2 * 7/2006 Graber, Jr. ..... 418/201.1
7,150,611 B2 * 12/2006 Perna ..... 418/201.1
2008/0193301 A1 * 8/2008 Fujii et al. ..... 418/9
2010/0089078 A1 * 4/2010 Kishi et al. ..... 418/9
2010/0296958 A1 * 11/2010 North et al. ..... 418/201.3

FOREIGN PATENT DOCUMENTS

GB 1220054 A * 1/1971 ..... F04C 18/16

OTHER PUBLICATIONS

International Search Report for International Application No. PCT/EP2010/061363, mailed on Jun. 22, 2011.

* cited by examiner

*Primary Examiner* — Mary A Davis
(74) *Attorney, Agent, or Firm* — McCarter & English LLP

(57) ABSTRACT

The invention relates to a dry-compressing dual-shaft rotary displacement screw spindle pump machine for delivering and compressing gases. The spindle rotor pair therein includes multiple stages, having a primary delivery thread, a secondary delivery thread and a gas outlet collector chamber therebetween. The primary delivery thread head circle diameter decreases in the gas outlet direction, while the foot circle diameter thereof increases correspondingly for an application-specific matching inner "integral" compression ratio. The secondary delivery thread nominal delivery direction is opposite to the primary delivery thread nominal delivery direction. The secondary delivery thread is implemented such that the actual gas flow direction is opposite to the nominal delivery direction thereof, and is always directed away from the gas outlet plenum, having a gas permeation under ambient pressure just as the space in the gearbox. A control gas delivery stage is additionally provided for very high operating pressures.

15 Claims, 6 Drawing Sheets

DISPLACEMENT PUMP WITH INTERNAL COMPRESSION

CROSS-REFERENCE TO RELATED APPLICATIONS

This application is a continuation of International Patent Application No. PCT/EP2010/061363, filed Aug. 4, 2010, designating the United States, claiming priority under 35 U.S.C. §119(a)-(d) to German Application No. DE 10 2009 029 047.8, filed Aug. 31, 2009 and to German Application No. DE 10 2009 051 096.6, filed Oct. 28, 2009, the contents of all of which are hereby incorporated by reference in their entirety as part of the present disclosure.

BACKGROUND INFORMATION

Dry-compressing pumps are becoming ever more important in industrial compressor technology. Due to increasing obligations with regard to environmental regulations and rising operating and disposal costs, as well as greater requirements with regard to the purity of the delivery medium, known wet-running pump systems, such as liquid ring machines, rotary vane pumps and oil or water-injected screw compressors, are replaced with dry-compressing pumps with increasing frequency. Dry screw compressors, claw pumps, diaphragm pumps, piston pumps, scroll machines, as well as Roots pumps, are among these dry-compressing machines. However, what these machines have in common is that they still do not meet today's requirements relating to reliability, ruggedness, constructional size and weight, while at the same time having a low price level and satisfactory compressor efficiency.

Known dry-compressing screw spindle pumps suggest themselves for improving this situation, because, like typical dual-shaft displacement machines, they obtain a high compression capacity simply by achieving the required multi-stage property as so-called "delivery threads" by a series arrangement of several sealed working chambers through the number of loops per compressor rotor in an extremely uncomplicated manner. Moreover, the contactless rolling of the screw spindle rotors that rotate in opposite directions enables an increased rotational speed of the rotors, so that the nominal suction capacity and the volumetric efficiency are increased at the same time, relative to the design size.

A simple rotor cooling system is described for a dry-compressing screw spindle pump in International Patent Application Publication No. WO 00/12899, wherein a coolant, such as oil, is introduced into a conical rotor bore in each rotor, in order to permanently dissipate a part of the compression heat produced during the compression process. Pursuing this approach in International Application No. PCT/EP2008/068364, the coolant is used with an internal (oil) pump, for cooling the pump housing in order to dissipate in a coolant circuit the absorbed amounts of heat from the compression of the delivery medium and the power dissipation via a separate heat exchanger in such a way that the clearance values between the rotor pair and the surrounding pump housing are maintained for all operating states.

For achieving greater compressor powers however, there is still no efficient and inexpensive solution to minimize the pump-specific forces in the axial and radial direction and minimize the compressor power values efficiently, reliably, robustly and inexpensively. Until now, dry-compressing screw compressors having two screw compressors with an intermediate gas cooling system still must be used for higher pressure values, for example, 11 bar as absolute pressure, with an unsatisfactory efficiency at the same time. Accordingly, the corresponding total expenditure is a constant nuisance, both with regard to the purchase of an intermediate gas cooling system additionally required due to two-compressor machines, as well as with regard to operation, due to the, on the whole, modest efficiency. This is desired to be improved significantly.

SUMMARY OF THE INVENTION

The object of the invention lies in improving the efficiency of dry-compressing dual-shaft rotary displacement machines for the compression and delivery of gaseous delivery media, and to reduce the expenditures also for higher compression pressures, as well as to significantly reduce the stresses due to the gas forces in the axial and radial direction.

According to the invention, this object is achieved by a dry-compressing screw spindle pump comprising an internal rotor cooling system for the spindle rotor pair and a cooling system for the pump housing surrounding the spindle rotors The multi-stage spindle rotor pair comprises an intermeshing primary delivery thread and, additionally, an intermeshing secondary delivery thread. On each screw spindle rotor pair, at the primary delivery thread, the outer tip circle diameter of the delivery thread decreases in the gas outlet direction, whereas the root circle diameter increases correspondingly, and the additional secondary delivery thread at each screw spindle rotor pair has a delivery thread whose nominal delivery direction is contrary to the nominal delivery direction on the primary delivery thread of the same spindle rotor. The result is that the secondary delivery thread has a delivery direction that is exactly inverse to that of the primary delivery thread.

The primary delivery thread may be initially configured in a cylindrical manner, with regard to the external diameter, until the inlet-side working chambers that open in order to scoop the delivery medium and enclose the delivery medium are approximately closed again. In order to improve this so-called "gulping" scooping behavior, the inlet-side pitch of the primary delivery thread is increased to a maximum value until the sucking working chambers close, and then are reduced in the direction of the gas outlet collector space in order to achieve the application-specific optimum internal compression ratio.

In the case of the primary delivery thread, this so-called "built-in" internal compression ratio, which is the ratio of the suction-side to the outlet-side working chamber volumes, is adapted to the operating pressure specifically for the application via the respective polytropic exponent, in such a way that the pressure in the final working chamber shortly before opening at the gas outlet collector space virtually corresponds to the desired compression outlet operating pressure.

Thus, the outlet-side gas pulsations are minimized and the machine becomes quieter. Moreover, harmful over and under-compression resulting in power loss is avoided. In the parameter design of the individual working chamber volumes, the internal, so-called "built-in" compression ratio is configured as desired by changing the values of pitch and diameter.

In the process, the gas feed for the delivery medium fitted to the housing is configured in such a way that this gas inlet to the sucking working chambers is reduced both in the radial and axial directions. Due to the fact that this machine has only one permitted direction of rotation, and apart from an as-generous-as-possible design of the cross-section in the gas inlet space with a comprehensive rotor access at the end face, this is done through additional inlet control edges fitted to the housing, which specifically extend into an initial portion of the cylindrical accommodation bore for the spindle rotors.

The gas outlet collector space for the delivery medium to be compressed is located between the primary delivery thread and the secondary delivery thread, with the primary delivery thread having a greater length in the axial direction than the secondary delivery thread. The actual task of the compressor, delivering and compressing the delivery medium with the desired nominal volume flow, is in this case performed virtually only by the primary delivery thread. In order to keep the power demand low, the secondary delivery thread is designed for a significantly lower delivery quantity volume flow, preferably 5 to 10 times less than the nominal volume flow of the primary delivery thread. According to such embodiments, the secondary delivery thread is placed between the gas outlet collector space of the primary delivery thread and the working space shaft ducts to the gear chamber, where the oil-lubricated bearing and the oil-lubricated drive gears as well as the inlet of the coolant (oil) into each of the two screw spindle rotors are located.

The delivery behavior of the secondary delivery thread is designed such that the gas flow from the secondary delivery thread that actually results in operation is set in the opposite direction to the nominal delivery direction of the secondary delivery thread, so that the resultant gas flow that actually results in operation is directed away from the gas outlet collector space and points toward the working space shaft duct to the oil-lubricated gear chamber. Although this gas flow constitutes a leakage or loss gas flow, it nonetheless reliably ensures the desired freedom from oil for the delivery medium in the pump working space.

In order to achieve this actual flow direction, the compression capacity of the secondary delivery thread is designed to be slightly lower than the compression capacity of the primary delivery thread by selecting the design parameters for this secondary delivery thread such that the actual gas flow is directed away from the gas outlet collector space of the primary delivery thread and points in the direction of the working space shaft duct. To this end, for example, the respective working chamber sizes in the secondary delivery thread are reduced in relation to the clearance values, and the number of stages is changed in such a way that the resulting compression behavior of the secondary delivery thread is slightly weaker than the compression behavior of the primary delivery thread. The amount of this leakage or loss gas flow via the secondary delivery thread is application-specific, with this leakage gas flow that flows away from the gas outlet collector space via the secondary delivery thread being designed to be smaller in applications with low oil-free requirements in the working space versus applications with high oil-free requirements in the working space.

The pressure in the gear chamber thus approximately corresponds to the ambient pressure and the two shaft ducts to the pump working space can be configured as contact-less labyrinth seals with a series connection of several separating chambers with as large as possible buffer volumes.

The secondary delivery thread is provided with a gas passage opening between the drive-end edge of own delivery thread and the working space shaft ducts to the gear chamber. With this design, a contamination of the working space with oil is reliably avoided, as the suction-side bearing of the screw spindle rotors is achieved with rolling bearings that are provided with lifetime grease-lubrication, or, in the case of special applications even with hybrid bearings, i.e., with ceramic balls running on steel bearing rings.

The pitch of the delivery thread is configured, both on the primary delivery thread as well as on the secondary delivery thread, in such a way that maximum number of possible stages of loops of the delivery thread on the screw spindle rotor is accomplished as so-called "multi-stage property." This number of loops or number of stages for describing this multi-stage property is to be at least 800 angular degrees. However, values exceeding 1100 loop angular degrees may be even more advantageous.

To this end, the flank pitch angles for the delivery thread are configured significantly smaller than in current screw compressor displacement rotors. In the case of the primary delivery thread, the flank pitch angle for the delivery thread on the rolling circle in the area of the diameters that change may be significantly less than 20°. Taking into account the practical tools of rotor manufacturing, the ratio of mean tooth-space depth to mean tooth-space width may be in a range of between 1.5 to 4, as a dimensionless ratio. The total length of the spindle rotors is configured to be as long as possible by essentially using only the speed critical to bending or the bending stress as a design limit.

However, there will also be designs with a constant pitch, in which the internal compression is then achieved via the diameter change on the delivery thread. This diameter change can take place in a linear manner or according to any other function, as will be understood by one of ordinary skill in the art.

By utilizing a high number of stages, the heat exchange surfaces are increased, the compressor efficiency is improved, the compression capacity of the machine is increased, and the gas forces in the radial direction are reduced. Furthermore, the requirement for the synchronization accuracy of the distortion angle in the driving toothing is reduced.

The conical design of the primary delivery thread significantly increases the bending stiffness in each screw spindle rotor due to the larger shaft cross sections, and the end-side spindle rotor shaft ends are also configured to be thicker. Moreover, on the spindle rotor drive side, the shaft of the rotor-fitted gears is laced as deeply as possible into the cooling bore in order to further improve the bending stiffness, with the necessary passage for the coolant (oil) being provided via longitudinal grooves in this plugged-in shaft of the rotor-fitted gear.

In some embodiments, the screw spindle rotor pair is configured mirror-identical and dual-threaded, thus having two teeth in the transverse section, so that working chambers of the same pressure are always located opposite from each other in equilibrium in each transverse section.

The outer diameter for the secondary delivery thread is selected in such a way, as will be understood by one of ordinary skill in the art, that the gas forces in the axial direction that are produced by the pressure difference between the inlet pressure at the gas inlet and the final compression pressure at the gas outlet collector space are compensated efficiently or absorbed in a beneficial manner by the bearing.

With the permanent heat dissipation via each rotor cooling cone and via the cooling system for the pump housing through the coolant, e.g., (oil), compression heat is efficiently dissipated during the compression between the gas inlet and the gas outlet, so that the compressor efficiency is significantly improved. The extent of this heat dissipation, and thus the increase of efficiency, is determined by the absolute machine size, the number of stages, the power level, the nominal suction capacity and the rotor speed in the pressure level desired specifically for the application, with the design concerning the "built-in" internal compression ratio. The rotor speed for the respective machine size is designed so that the nominal suction capacity and the number of stages with the desired heat dissipation correspond optimally to the application-specific requirement profile, and also keeping (cost) expenditure in mind. Thus, according to a building-block approach, there will be machines according to the invention that, for cost-saving reasons, reach the application-specific performance figures with as little material usage as possible through high rotor speed, in which case the heat dissipation and compressor efficiency is less favorable than a geometrically bigger machine, which would initially be more expensive. Therefore, the design that is best suited to the specific application is to be implemented.

The internal rotor cooling system is in some embodiments a conical rotor bore into which the coolant (most frequently oil) is permanently introduced, and extends in the area of the increasing root circle diameter of the primary delivery thread, in accordance with, for example, the teachings of International Patent Application Publication No. WO 00/12899. In this case, the angles of the cone cooling bore for the internal rotor cooling system and the angles of the changing root circle diameters at the primary delivery thread have the same orientation, so that the root circle diameter at the primary delivery thread increases as the bore diameter in the conical rotor cooling bore increases. Due to the conical design at the primary delivery thread with the diameter changes running in the same direction, the cooling cone angle can be increased for improving heat dissipation.

Furthermore, this internal rotor cooling system also suffices for a sufficient heat dissipation at the secondary delivery thread, the cone cooling angle not needing to be so steep anymore because the cooling oil already arrives at a high speed for good heat transfer coefficients along with large cooling bore diameter values, so that a reliable heat dissipation is thus ensured.

The secondary delivery thread may be configured to be cylindrical, i.e., with constant values for the outer tip circle diameter as well as for the root circle diameter, and can also be manufactured with a constant pitch to simplify production.

In order to specifically reduce the gas temperatures during compression, it is provided according to certain embodiments, that a delivery medium partial flow is branched off from a transport area with a higher pressure, cooled by a heat exchanger, and returned to one or more areas of the primary delivery thread with a lower pressure. This process shall be referred to as "return gas cooling."

A lower temperature and also a higher pressure will occur as desired by mixing in the area of the returned delivery medium partial flow. For an optimum temperature reduction, the best cooling process for this partial flow is a downstream gas cooler for the compressed air under operating overpressure, which is required anyway at the end of the compression process, wherein a downstream heat exchanger has to significantly reduce the temperature of the compressed air, as is known, in order to be able to fulfill the desired tasks with this compressed air in an application-specific manner without any problems.

With the mixing process in the area of the return of a cooled partial flow, the pressure curve along the spindle rotor axis is also changed in that there is a faster increase in pressure. Therefore, for the compression capacity with the internal "built-in" compression ratio of these displacement machine designs, both the pitch profile as well as the number of stages can be adapted in accordance with this changed pressure curve in such a way that, at the end of the compression, the pressure in the last closed working chamber again approximately matches the pressure in the gas outlet collector space.

The gas cooler for heat dissipation from this branched-off delivery medium partial flow can also be a separate heat exchanger, which can moreover be operated with the coolant that is already used for internal rotor cooling and for heat dissipation for the pump housing.

The return of a cooled delivery medium partial flow is "driven" by the pressure difference between the access points. In order to maintain the radial equilibrium of forces for the two spindle rotors, the connections to the return gas cooling system in the pump working space should be achieved in an identical manner.

If there are different application-specific operating pressures, it is technically and energetically beneficial if the internal compression ratio of the compressor optimally adapts to these changing application conditions as simply as possible by matching the gas pressure in the last working chamber of the compressor, shortly before this working chamber opens at the gas outlet collector space, to the pressure that currently exists on the gas outlet side, or that is currently respectively desired. To this end, the internal compression ratio of the compressor is influenced, by a relative shift in the axial direction between the screw spindle rotor pair and the surrounding pump housing at the primary delivery thread. This is done in such a way that this internal compression ratio of the compressor respectively adapts optimally to the different application-specific operating pressures in that, due to this axial shift between the screw spindle rotor pair and the pump housing, different compression capacities result only in the conical area of the primary delivery thread because of the variable gas return flows, owing to the slit heights, that are variable due to this axial shift, between the rotor heads and the surrounding pump housing in the conical area of the primary delivery thread, so that the internal compression ratio of the compressor follows the prevailing conditions as well as possible because of this shift.

The relative shift is controlled by the axial gas pressure difference forces and/or the power input. Due to the design of the primary delivery thread, which is cylindrical according to the invention, a reduction of the nominal suction capacity is avoided in the described axial shift at the same time, because this axial shift in the cylindrical area practically causes no changes in the gas transport volume.

The actual implementation of this axial shiftability is also carried out, for example, at the locating bearing, like in the design for the suction-side bearing. However, the fixed bearings are shifted jointly as a unit in order to maintain the axial position of the two spindle rotors relative to each other.

Alternatively, this axial shift can also be done at the pump housing, which is facilitated by the constitution of the cooling oil, for example, by means of an axially displaceable housing insert.

At the suction-side bearing, the outer bearing ring is seated firmly in a carrier bushing that can be shifted in the axial direction in order to always reliably ensure the floating bearing function. An oil chamber with a bilateral seal is provided between the carrier bushing and the accommodation bore in the pump housing in order to facilitate axial mobility.

DETAILED DESCRIPTION OF THE INVENTION

Figure 1:
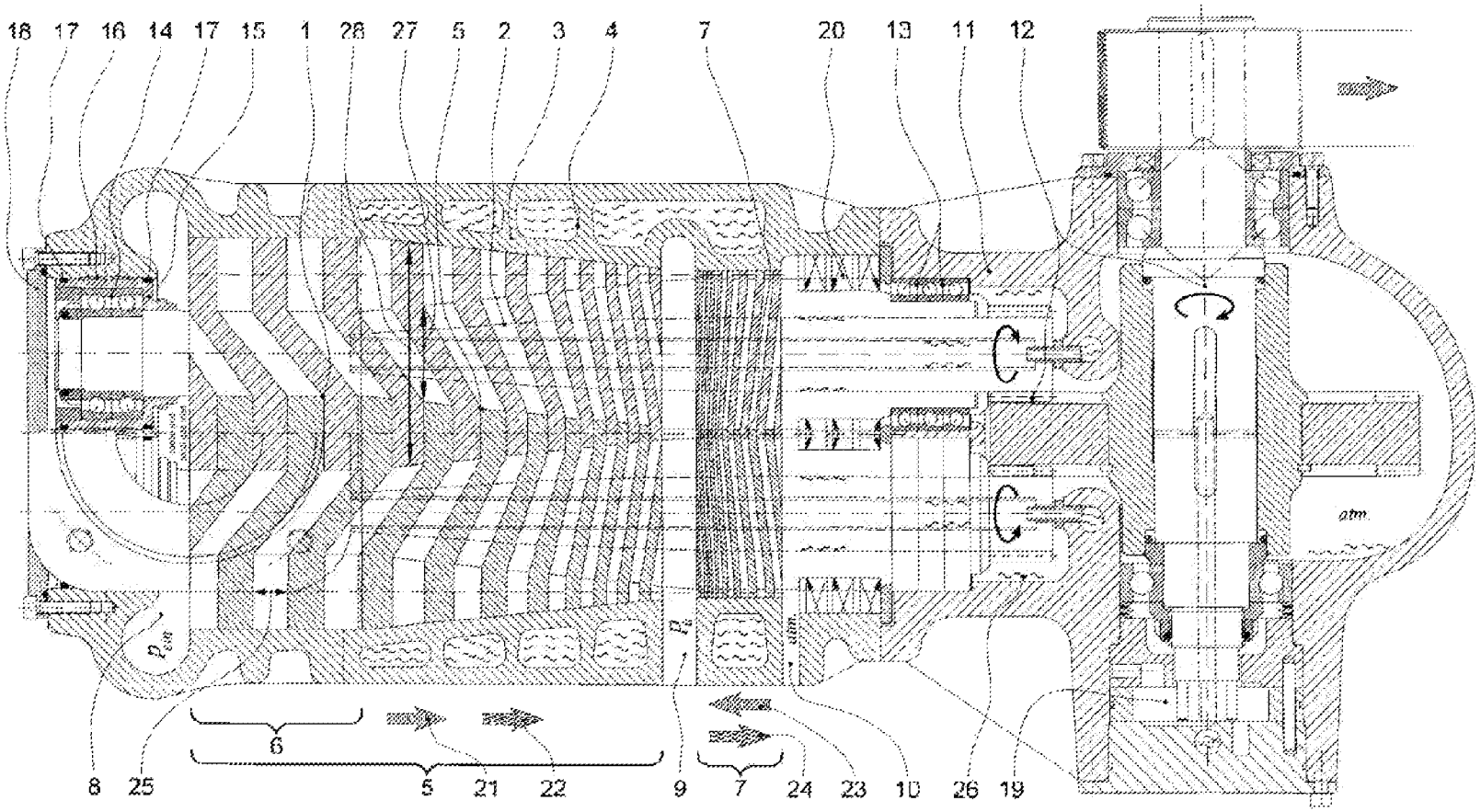
FIG. 1 is a sectional view of a screw spindle pump.

FIG. 1 shows an embodiment in a sectional view through the entire screw spindle pump. The minor-identical rotor pair (1) rotates in a pump housing (3) with a gas inlet (8) and a gas outlet collector space (9). The rotor pair is driven by a crown or bevel gear (12) with a drive shaft in such a way that the displacement rotors rotate in opposite directions and without contact in the pump working space. The driving motor is not shown separately.

Each screw spindle rotor is retained, on the gas inlet side, in rolling bearings (14) that are provided with lifetime grease-lubrication as a floating bearing arrangement and, on the drive side, in oil-lubricated rolling bearings (13) as a locating bearing arrangement for securing the axial rotor position. The working chamber shaft seals (20) for both spindle rotor shaft ends are located between the pump working space and the oil-lubricated space of the gear case (11). The internal cooling system (2) for each screw spindle rotor is shown in dashed lines and is shown more clearly in the embodiment of FIG. 3. At the screw spindle rotor pair, the intermeshing primary delivery thread (5) between the gas inlet (8) and the gas outlet collector space (9) is shown in a simplified illustration. The secondary delivery thread (7) between the gas outlet collector space (9) and the working chamber shaft seals (20) with the gas passage (10) is shown in the same manner. At the primary delivery thread (5), the nominal delivery direction (21) and the actual primary gas flow direction (22) are directed in the same direction from the gas inlet (8) towards the gas outlet collector space (9). In contrast thereto, the nominal delivery direction (23) in the case of the secondary delivery thread (7) points from the gas passage (9) to the gas outlet collector space (9), whereas the actual gas flow (24) through the secondary delivery thread (7) runs in the other direction, as a so-called "leakage or loss gas flow." The gas outlet collector space (9) is under operating compressor pressure $p_{ü}$, whereas the gas inlet (8) is under the pressure $p_{ein}$, and both the gas passage (10) for the secondary delivery thread (7) and the space in the gear case (11) are under ambient pressure, simply referred to as "atm."

As can be seen well, the primary delivery thread (5) comprises a cylindrical section (6) and a conical part with a change of the tip circle diameter (28) and the root circle diameter (27). For the continuous cooling during compression, the coolant (26), which at the same time is the lubricant in the gear chamber, is delivered by the delivery pump (19) to the internal spindle rotor cooling system (2) and to the heat dissipation surfaces (4) of the pump housing (2). The high number of stages on the spindle rotor according to the illustration on the one hand provides for the desired high compression capacity from $p_{ein}$ to $p_{ü}$, as well as for a sufficient number of heat exchange surfaces together with the pump housing cooling system, in order to dissipate compression heat in a appreciable extent during the gas transport, which is known to increase the compressor efficiency in the desired manner.

Figure 2:
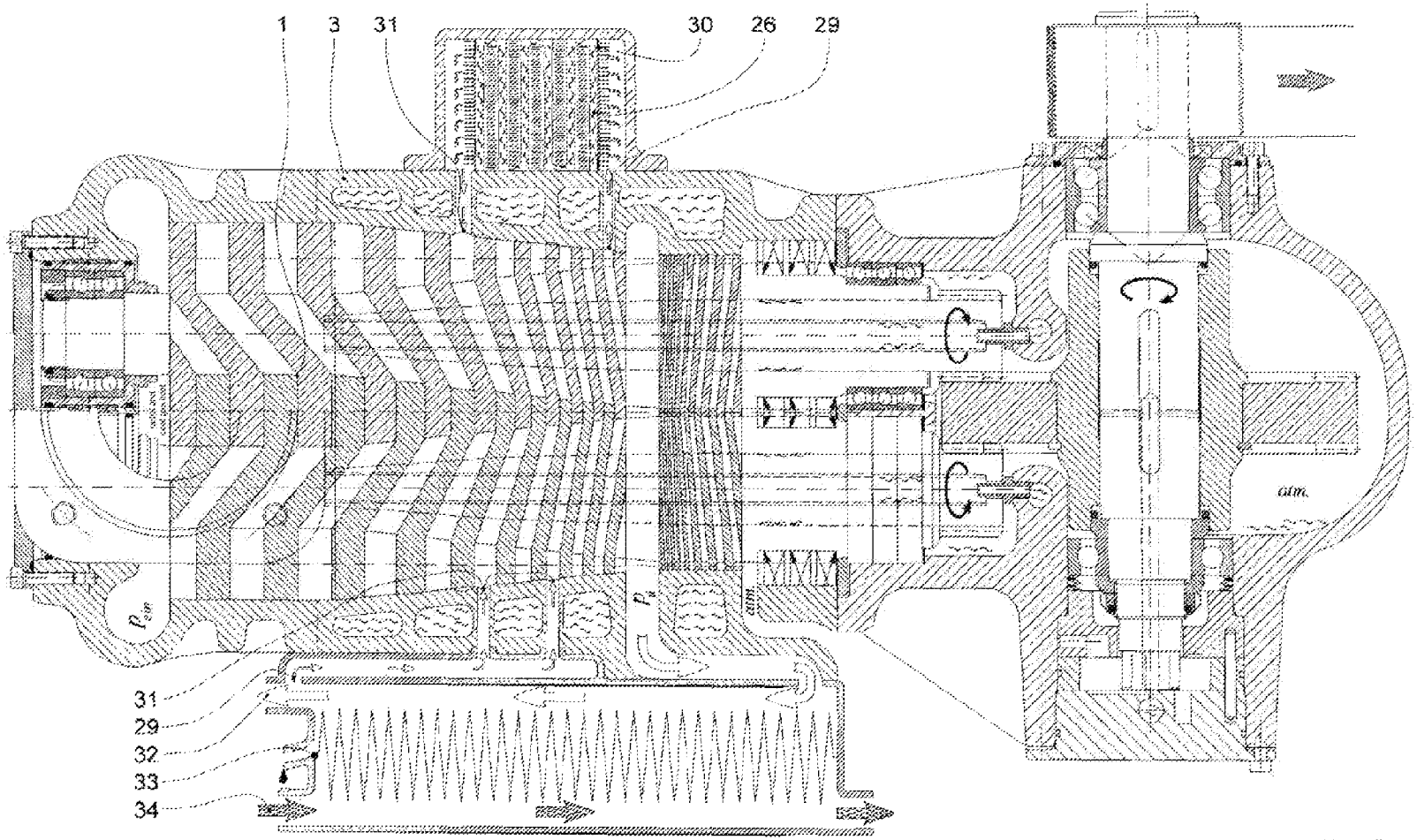
FIG. 2 is a sectional view of another embodiment of a the screw spindle pump, with a return gas cooling system.

FIG. 2 shows, an embodiment for specifically reducing the gas temperatures during the compression through the "return gas cooling system". With the branch-off (29) of a partial delivery medium quantity and the return (31) of this partial quantity into the pump working space, this return gas cooling system via a separate heat exchanger (30) is thus shown in the upper area. In the lower area, the partial delivery medium quantity (31) returned into the working space is branched off directly from the delivery medium (32) which, as a rule, has to be cooled anyway in the downstream cooler (33). In this case, this cooler (33) is usually operated with an external cooling fluid (34), which is most frequently air or (more rarely) water. The return (31) of the cooled partial delivery flow quantity into the pump working space takes place symmetrically for both screw spindle rotors (1) at the same longitudinal axis position.

Figure 3:
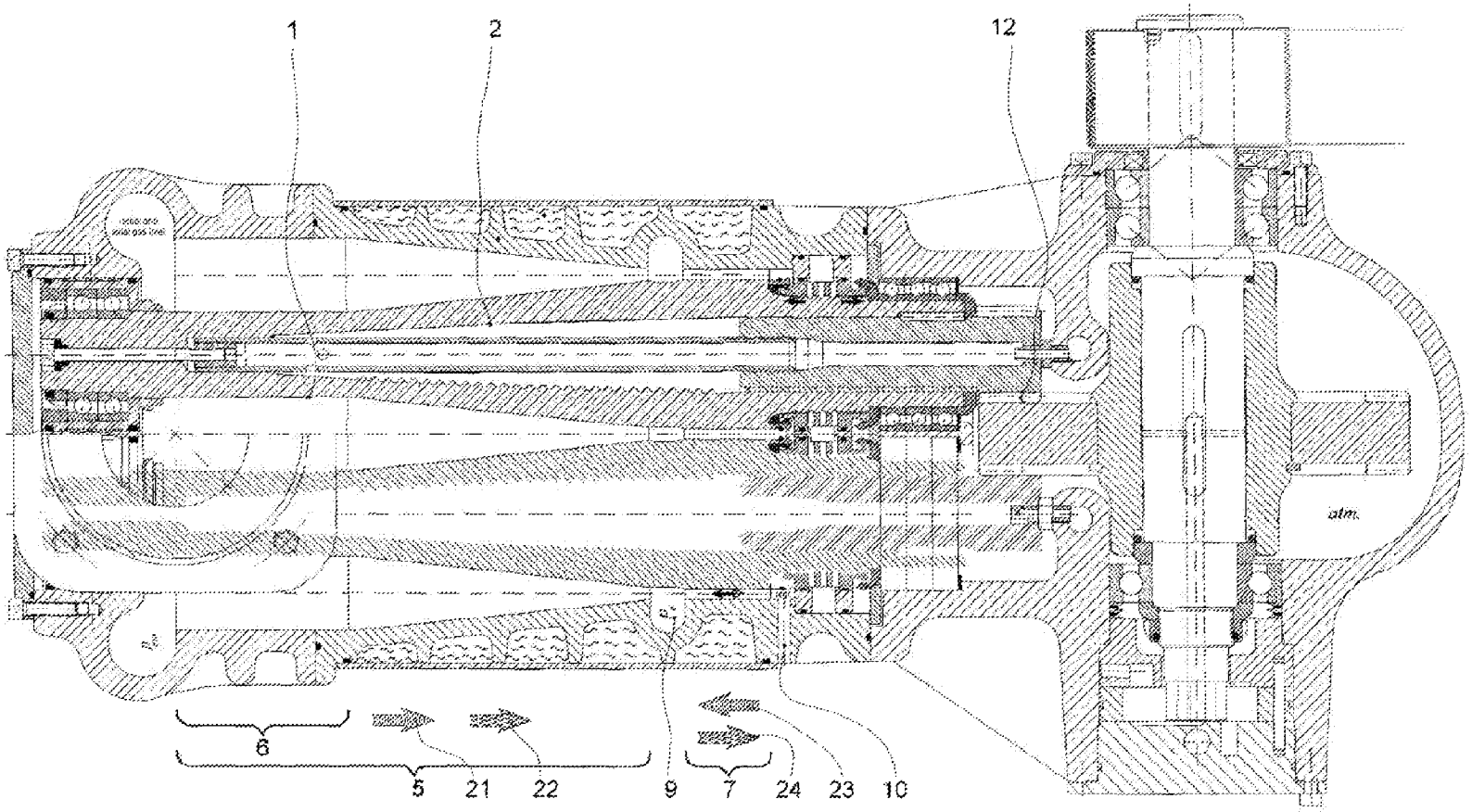
FIG. 3 is a sectional view of another embodiment of a screw spindle pump.

FIG. 3 shows, as an embodiment, a detailed section drawing as a virtually complete construction draft. In this case, the illustration of the internal rotor cooling system (2) is shown in more detail, as is the design of the rotor-fitted gear of the crown wheel drive (12) within the meaning of an improved bending stiffness at the drive-side shaft end of the screw spindle rotor (1). In the case of the internal cooling system (2), a wave-shaped thread for increasing the cooling surface is shown as an example, for illustration purposes only, on one side of the conical cooling bore. In other respects, the description according to FIG. 1 applies to this embodiment.

Figure 4:
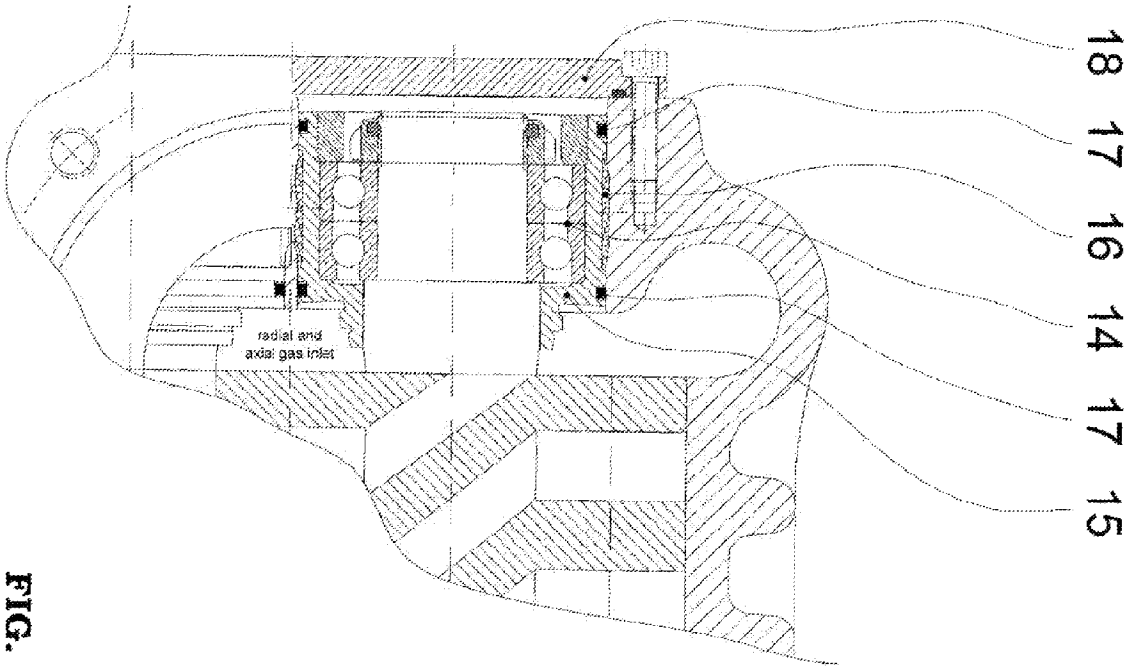
FIG. 4 is an enlarged part of FIGS. 1 and 2, showing the suction-side bearing, the axially displaceable carrier bushing, and the seals.

FIG. 4 shows in a more detailed manner the embodiment of the suction-side bearing (14) with the improvement of the desired floating bearing function through the axially displaceable carrier bushing (15) with an oil-filled recessed space (16) and the seals (17). In this case, the outer bearing ring of the suction-side bearing (14) is firmly seated in the carrier bushing (15). Possible co-rotation of the carrier bushing (15) can be prevented, for example, by means of pins on the end face, which are in this case not shown separately. Normally, however, the friction of the two sealing rings (17) should reliably prevent undesired co-rotation of the carrier bushing (15). In the embodiment paired rolling bearings for the suction-side bearing arrangement (14) in an O- and an X-arrangement can be selected, as is generally known. Both designs are shown in this Figure for the sake of convenience.

This embodiment of the axial shiftability can at the same time also be used for the above-described option of the relative axial shifting between the screw spindle rotor pair (1) and the surrounding pump housing (3), by its locating bearing (13) also being seated in a displaceable carrier sleeve. However, this carrier sleeve is absolutely required to comprise the rotor locating bearings (13) of both screw spindle rotors.

Figure 5:
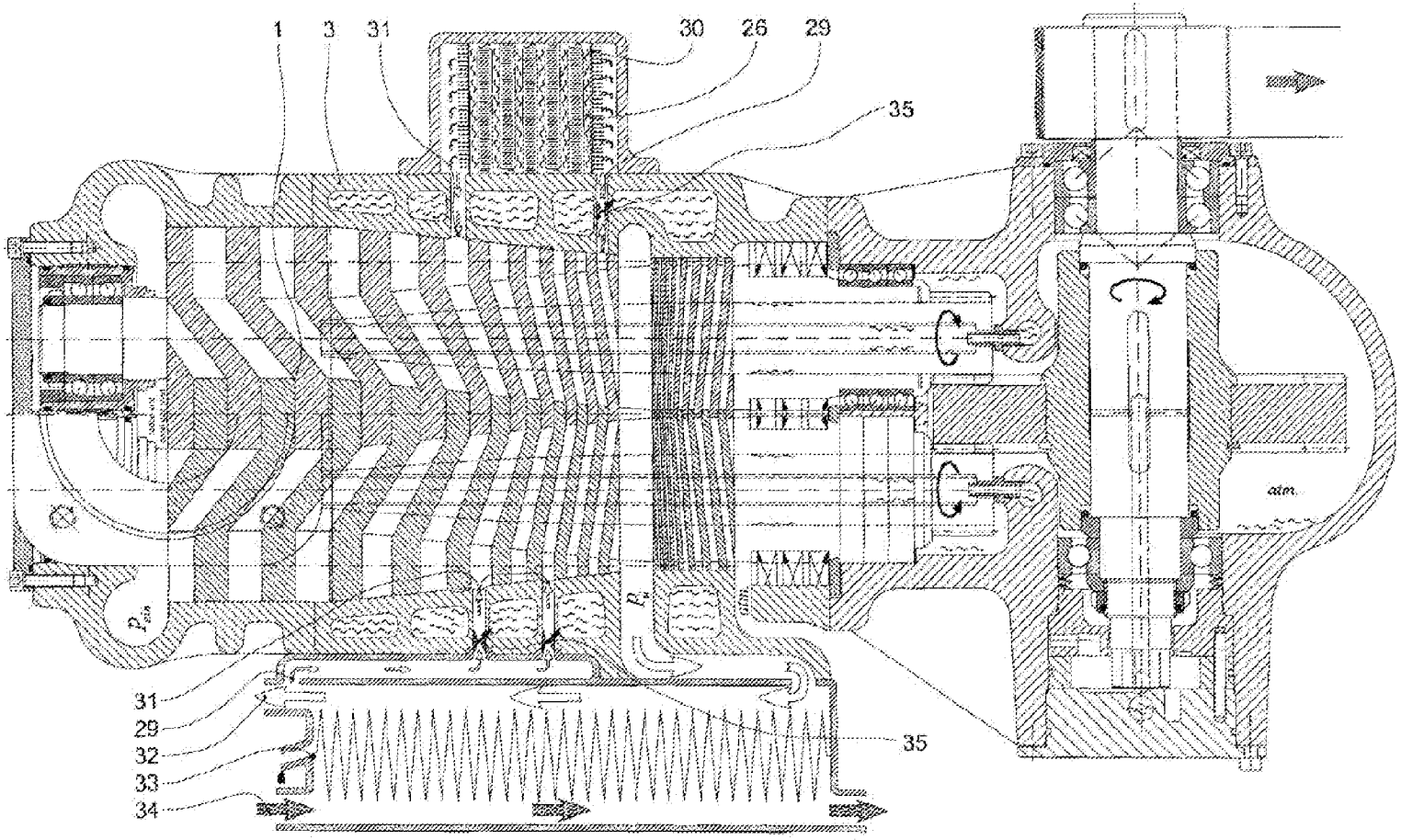
FIG. 5 is a sectional view of another embodiment of a cooling system and a control device.

With respect to the aforementioned "return gas cooling system," which is shown in an exemplary manner in FIG. 2, for some applications, as shown in FIG. 5, the gas quantity at the branch-off (29) of the partial delivery medium quantity may be specifically adapted to the respective application requirements by means of a control device (35).

An axially acting force that must be absorbed by the rotor bearing may still be generated in the conical area of the primary delivery stage (5) due to the pressure increase in the longitudinal direction of the rotor. This is because the diameter at the secondary delivery stage, due to the fact that it can be installed, may not be enlarged arbitrarily in order to compensate these axial forces completely. In particular with regard to higher operating overpressures $p_{ü}$, it may now make sense, in order to compensate this axial load, to additionally provide a control gas delivery stage (39), such as the exemplary illustration of FIG. 6, that is attached to both inlet-side spindle rotor shaft ends. In this case, the control pressure $p_{ax}$ in the control gas collector space (37) is adjusted via a pressure/quantity regulating device (36) as a minimal partial flow (40), branched off from the cooled delivery medium (32), in such a way that the resulting axial forces reach the desired low load level for the spindle rotor bearing (13).

The control gas delivery stage (39) has a nominal delivery direction (41) that is directed in an opposite direction to the nominal delivery direction (21) of the primary delivery stage (5). In this case, the control gas delivery stage (39) is located in a control gas housing (38) and is operated on the one side in the collector space (37) with the pressure $p_{ax}$ and on the other side with the pressure $p_{ein}$, with the inlet pressure $p_{ein}$ being ensured through a bypass opening (42).

Figure 6:
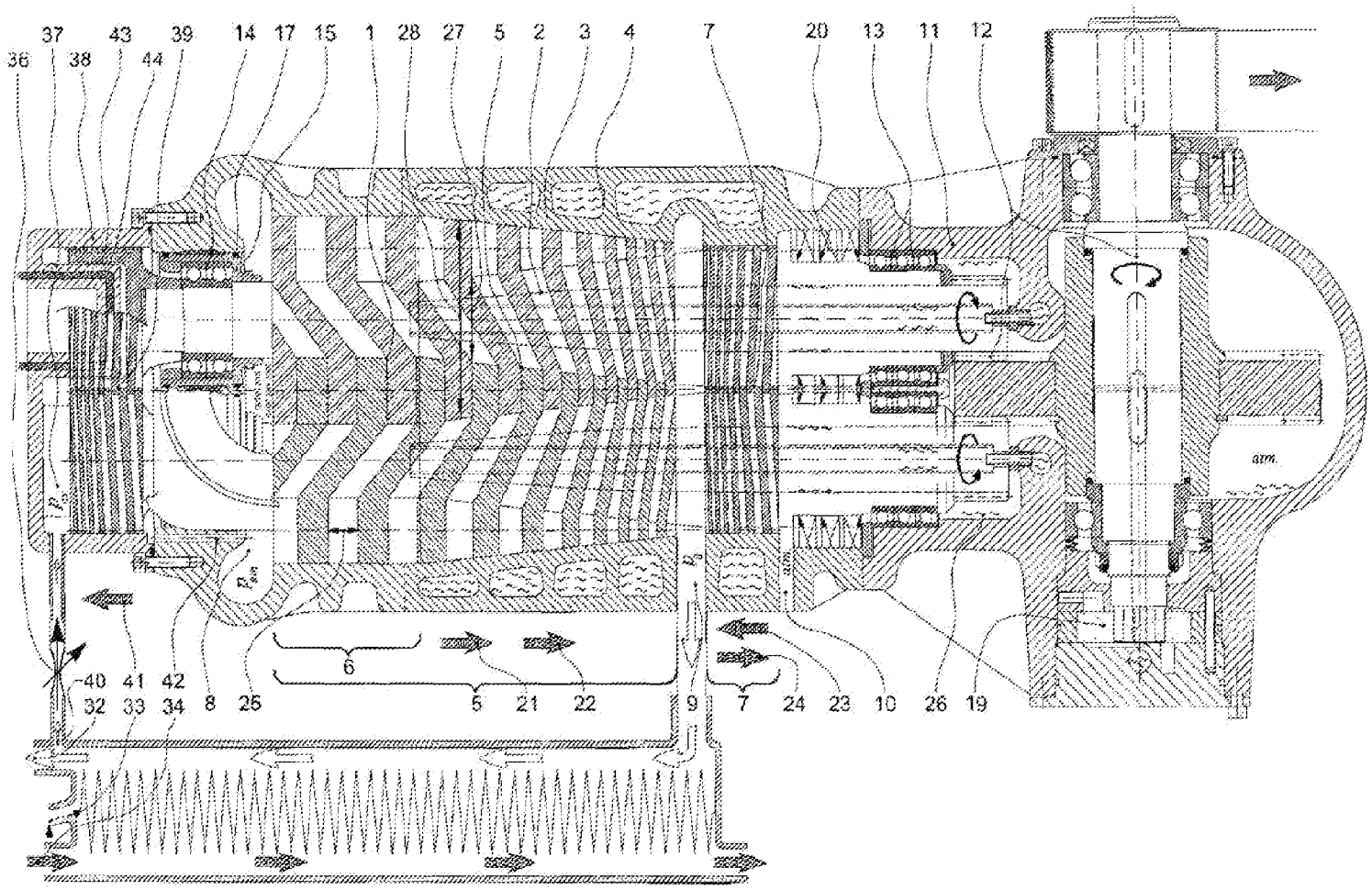
FIG. 6 is a sectional view of another embodiment of a screw spindle pump, with a control gas delivery stage.

Furthermore, another option for dissipating the rotor heat at the control gas delivery stage (39) is to provide, such as in accordance with the exemplary illustration in FIG. 6, a cup-shaped cooling system (44) protruding into each rotor section of the control gas delivery stage (39), that absorbs heat from the rotor via a narrow cooling gap (43) and transfers it onto the coolant (39) in the cooling cup. By way of example, this cooling system is shown in a more detailed manner in FIG. 6 only on one rotor section of the control gas delivery stage (39).

It is furthermore possible that, through a non-linear profile of the diameter change in the conical area of the primary delivery stage (5), the resulting axial forces may be reduced by the diameter change, corresponding to the pressure increase along the conical primary delivery stage, in such a way that the axial working chamber gas forces are minimized.

For example, the diameter change in the conical area of the primary delivery stage may be configured to be smaller in an area along the spindle rotor axis with a higher pressure increase than in an area with a lower pressure increase, where the diameter is changed to a greater extent. In this case, the profile of the internal compression achieved, besides by changing the diameter, also by changing the pitch along the rotor axis.

Both the secondary delivery stage (7) as well as the control gas delivery stage (39) are referred to below as "additional stages." This pertains to both each individual one of these stages, as well as to both stages, so that the following statements are to be taken to relate to both each individual one as well as to both:

The parameter of the additional stages may be designed to be "motor-operated." In such embodiments, the pressure difference along the delivery thread of these additional stages is used to drive the rotors of these additional stages. These additional stages do not act as a pump delivering a delivery medium from a lower to a higher pressure. Rather, these additional stages act as a motor that relaxes the available gas with a higher pressure to a lower pressure level, driving the displacement rotors of the additional stages in the process. Technically, this is done by the parameters for these additional stages being configured in such a way that the idle speed, i.e., the rotational speed of these additional stage displacement rotors without mechanical loss, is higher than the subsequent actual operating speed of the primary delivery stage.

At the same time, the gas quantity for each additional stage may be minimized in the parameter design, for example, by increasing the number of stages and/or reducing the clearance values.

The additional stages may be configured in a single-toothed, also referred to as "single-threaded," manner.

As may be recognized by those of ordinary skill in the pertinent art based on the teachings herein, numerous changes and modifications may be made to the above-described and other embodiments of the present invention without departing from the scope of the invention as defined in the claims.

What is claimed is:

1. A dry-compressing dual-shaft rotary displacement screw spindle pump machine for delivering and compressing gaseous delivery media, comprising:

a pump housing, a contactless and counter-rotating multi-stage screw spindle rotor pair within the pump housing comprising an intermeshing primary delivery thread and an intermeshing secondary delivery thread, an internal rotor cooling system operating with a coolant for said screw spindle rotor pair, and a gas inlet and a gas outlet collector space for the delivery media, wherein said gas outlet collector space is located between the primary and secondary delivery threads, wherein an outer tip circle diameter of the primary delivery thread decreases in a direction from the gas inlet toward the gas outlet collector space, a root circle diameter of the primary thread correspondingly increases in the direction from the gas inlet toward the gas outlet collector space, and a nominal delivery direction of the secondary delivery thread is in a direction opposite a nominal delivery direction of the primary delivery thread.

2. A screw spindle pump according to claim 1 wherein the second delivery thread includes multiple stages.

3. A screw spindle pump according to claim 1, wherein, for each rotor of the screw spindle rotor pair, the primary delivery thread and the secondary delivery thread have loop degrees of at least 800 angular degrees.

4. A screw spindle pump according to claim 1 wherein the primary delivery thread comprises a cylindrical portion at a side thereof adjacent the gas inlet.

5. A screw spindle pump according to claim 1, wherein a pitch and a tooth height or tooth-space depth of the primary delivery thread decrease in the direction towards the gas outlet collector space, so that a pressure within a chamber of the primary delivery thread directly adjacent the gas outlet collector space corresponds to an operating pressure at the gas outlet collector space.

6. A screw spindle pump according to claim 1, wherein a nominal volume flow of the secondary delivery thread is smaller by a factor of approximately 5 to 10 times than a nominal volume flow of the primary delivery thread.

7. A screw spindle pump according to claim 1, wherein the secondary delivery thread is configured such that gas flow at the secondary delivery thread flows in a direction opposite to the nominal delivery direction thereof, providing leakage gas flow in a direction away from the gas outlet collector space.

8. A screw spindle pump according to claim 1, wherein the internal rotor cooling system is conical, and the root circle diameter of the primary delivery thread increases in a same direction as a diameter of the conical internal rotor cooling system.

9. A screw spindle pump according to claim 1, further comprising a rotor bearing adapted to maintain an axial position of the screw spindle rotor pair, and a gas passage operatively connected to the second delivery thread, wherein an outer diameter of the secondary delivery thread is configured such that axial forces resulting from pressure difference between pressure at the gas inlet and pressure at the gas outlet collector space as well as ambient pressure at the gas passage are substantially compensated and absorbed by the rotor bearing.

10. A screw spindle pump according to claim 1, further comprising an axially displaceable carrier bushing and a suction-side bearing having an outer ring seated in said carrier bushing.

11. A screw spindle pump according to claim 1, further comprising a carrier bushing and a housing bore accommodating the carrier bushing, wherein at least one of the carrier bushing and the housing bore comprises recessed spaces filled with oil and sealed by seals.

12. A screw spindle pump according to claim 7, further comprising a gas passage connected to the secondary delivery thread and the gas inlet for the leakage gas flow.

13. A screw spindle pump according to claim 1, further comprising a downstream cooler for the delivery media and a branch-off for a partial quantity of the delivery media located at an end of the downstream cooler.

14. A screw spindle pump according to claim 1, wherein the tip circle diameter and the root circle diameter of a conical portion of the primary delivery thread change less in an area of higher pressure increase along a spindle rotor axis than in an area of lower pressure increase along the spindle rotor axis, and said diameter values change to achieve desired diameter values at the gas outlet collector space.

15. A screw spindle pump according to claim 1 wherein desired internal compression is obtained by varying chamber size by varying at least one of a pitch of the primary delivery thread, the root circle diameter, and the tip circle diameter.

* * * * *

UNITED STATES PATENT AND TRADEMARK OFFICE

CERTIFICATE OF CORRECTION

PATENT NO. : 8,876,506 B2
APPLICATION NO. : 13/408191
DATED : November 4, 2014
INVENTOR(S) : Ralf Steffens It is certified that error appears in the above-identified patent and that said Letters Patent is hereby corrected as shown below:

In the Title page, insert item:

--(30) Foreign Application Priority Data

October 28, 2009 (DE)..... 10 2009 051 096.6
August 31, 2009 (DE)..... 10 2009 029 047.8--

Signed and Sealed this
Seventeenth Day of March, 2015

Michelle K. Lee

Michelle K. Lee
*Director of the United States Patent and Trademark Office*